US009682813B2

(12) United States Patent
Blyth et al.

(10) Patent No.: US 9,682,813 B2
(45) Date of Patent: Jun. 20, 2017

(54) FOOD PACKAGING

(75) Inventors: Simon Blyth, Sir Gaerfyrddin (GB); Dominic Cort, Sir Gaerfyrddin (GB); Hayley Dixon, Sir Gaerfyrddin (GB)

(73) Assignee: INTERCONTINENTAL GREAT BRANDS LLC, East Hanover, NJ (US)

( * ) Notice: Subject to any disclaimer, the term of this patent is extended or adjusted under 35 U.S.C. 154(b) by 472 days.

(21) Appl. No.: 14/233,434

(22) PCT Filed: Jul. 20, 2012

(86) PCT No.: PCT/GB2012/051745
§ 371 (c)(1),
(2), (4) Date: May 30, 2014

(87) PCT Pub. No.: WO2013/011328
PCT Pub. Date: Jan. 24, 2013

(65) Prior Publication Data

US 2014/0284244 A1 Sep. 25, 2014

(30) Foreign Application Priority Data

Jul. 20, 2011 (GB) ..... 1112444.3

(51) Int. Cl.
*B65D 85/00* (2006.01)
*B65D 85/60* (2006.01)
(Continued)

(52) U.S. Cl.
CPC ..... *B65D 85/60* (2013.01); *B65D 71/063* (2013.01); *B65D 75/42* (2013.01); *B65D 75/527* (2013.01);
(Continued)

(58) Field of Classification Search
CPC ..... B65D 85/60; B65D 71/06; B65D 71/063; B65D 71/066; B65D 75/40; B65D 75/42;
(Continued)

(56) References Cited

U.S. PATENT DOCUMENTS 2,272,623 A 8/1939 Runner
2,210,196 A * 8/1940 Baldwin ..... B65D 73/0028 206/449
(Continued)

FOREIGN PATENT DOCUMENTS

DE 1221963 7/1966
DE 3437351 4/1985
(Continued)

OTHER PUBLICATIONS

Chinese Patent Office; Chinese Application for Invention No. 201280035714.5; Second Office Action dated: Jun. 30, 2015 with English Translation.
(Continued)

*Primary Examiner* — Steven A. Reynolds
*Assistant Examiner* — Javier A Pagan
(74) *Attorney, Agent, or Firm* — Cantor Colburn LLP

(57) ABSTRACT

A gum packaging 100 holding a plurality of gum products is provided. Advantageously, and in accordance with the exemplary embodiment, one or more gum packet portions 200 can be torn from the gum packaging 100 in order to reduce the size of the gum packaging 100. Here, each gum packet portion 200 contains a dosage of gum. Consequently, a retail outlet may sell gum packaging 100 having a user required number of gum dosages by tearing from a main gum packaging 100 a sub gum packaging 100 for purchase, wherein the sub gum packaging 100 has the required number of gum packet portions 200 according to the buyers wishes. Furthermore, a user may purchase a main gum packaging 100 and remove a sub gum packaging 100 having a required dosage for that day or activity, where the sub gum packaging 100 has the required number of gum packet portions 200 according to the selected dosage. This is advantageous because the user only has to carry around the gum required.
(Continued)

Moreover, as the gum is consumed and the used gum packet portions 200 torn or otherwise separated from the gum packaging 100, the gum packaging becomes smaller, and therefore more comfortable to carry around.

17 Claims, 14 Drawing Sheets

(51) Int. Cl.
*B65D 71/06* (2006.01)
*B65D 75/42* (2006.01)
*B65D 75/52* (2006.01)
*B65D 75/58* (2006.01)

(52) U.S. Cl.
CPC ..... *B65D 75/5888* (2013.01); *B65D 2313/08* (2013.01)

(58) Field of Classification Search
CPC ..... B65D 75/44; B65D 75/46; B65D 75/48; B65D 75/527; B65D 75/5888
See application file for complete search history.

(56) References Cited

U.S. PATENT DOCUMENTS

| | | | | |
|---|---|---|---|---|
| 2,649,199 | A | 8/1953 | Werman | |
| 3,343,746 | A * | 9/1967 | Shiffman | B65D 21/0227 206/503 |
| 4,735,342 | A | 4/1988 | Goldstein | |
| 4,940,141 | A | 7/1990 | Philpot | |
| 6,364,112 | B1 | 4/2002 | Pitschka | |
| 2003/0192640 | A1 | 10/2003 | Belt | |
| 2006/0086682 | A1 | 4/2006 | Iwasaki et al. | |
| 2007/0003171 | A1 | 1/2007 | Boosalis | |
| 2007/0224312 | A1* | 9/2007 | Aldridge | B65D 75/30 426/5 |

FOREIGN PATENT DOCUMENTS

| | | |
|---|---|---|
| DE | 9206560 | 8/1992 |
| DE | 102005022629 | 11/2006 |
| EP | 1857376 | 11/2007 |
| FR | 1000263 | 2/1952 |
| FR | 1344782 | 11/1963 |
| FR | 2560521 | 9/1985 |
| FR | 2856381 | 12/2004 |
| GB | 1214623 | 12/1970 |
| GB | 2143797 | 2/1985 |
| GB | 2350597 | 12/2000 |
| GB | 2352439 | 1/2001 |
| JP | 5036040 | 10/1975 |
| JP | 11001220 | 1/1999 |
| JP | 11321813 | 11/1999 |
| JP | 2000053159 | 2/2000 |
| JP | U3090676 | 10/2002 |
| JP | 2006298394 | 11/2006 |
| WO | 0030189 | 5/2000 |
| WO | 0125112 | 4/2001 |
| WO | 0162621 | 8/2001 |
| WO | 03057590 | 7/2003 |
| WO | 2007098160 | 8/2007 |
| WO | 2008035879 A1 | 3/2008 |

OTHER PUBLICATIONS

ISR and WO_PCTGB2012051745_WO2013011328 dated Dec. 20, 2012.
GB SR 1112444.3 dated Feb. 28, 2012.
JP OA dated Jan. 27, 2015, Application No. 2014-520734.
Extended European Search Report; European Application No. 16162890.4; Mailing Date: Jan. 7, 2016; 7 Pages.

* cited by examiner

FOOD PACKAGING

FIELD

The disclosure relates to food packaging for confectionery or the like and in particular, although not exclusively, to gum packaging.

BACKGROUND

A variety of types of gum packaging are known. The purpose of the gum packing is, amongst others, to provide a wrapping for the gum in order to keep the gum fresh, in a hygienic condition until consumption, and to provide branding opportunities. It is known to wrap a number of gum pellets or slabs in a single packaging. For instance, it is known to wrap a number of stacked gum pellets within a folded sheet and it is also known to stack individually wrapped slabs of gum that are held together in a group by an additional outer sheath. However, when the wrapping to the stacked gum pellets is opened, the stacked pellets not immediately consumed become exposed and may lose freshness/hygiene and may also be spilt. Also, when an individually wrapped slab of gum is removed from the outer sheath, the outer sheath may not hold the remaining slabs together and they may be separated. Often the packaging is squashed down after some of the gum has been removed in order to keep the remaining gum in place or to keep dirt out. However, this can be unsightly.

Known gum packaging is relatively inflexible. That is, irrespective of how much gum they are likely to want or require, the user has to buy or carry the amount of gum supplied in the packaging or, when carrying a used package, the amount remaining in a used packet. Thus, often the gum packaging is larger than required and, because of the fixed size at point of sale, users are not able to purchase a quantity based on money they have on them at the time.

SUMMARY

The embodiments discussed herein attempt to overcome at least one of the above or other disadvantages. It is a further aim to provide a packaging that can be used flexibly to buy or carry the amount required by a given user.

According to the disclosure there is provided an apparatus and method as set forth in the appended claims. Other features will be apparent from the dependent claims, and the description which follows.

According to one aspect there is provided a food packaging comprising two or more food packet portions. A particularly suitable embodiment comprises a confectionary packaging having confectionary packet portions. However, due to the particular use, the exemplary embodiments are described in relation to gum packaging having gum packet portions. Consequently, although herein the exemplary embodiments are described in relation to gum packaging, it will be appreciated that the same packaging may also be used to package confectionary or other suitable food (including drink) products.

In the exemplary embodiments, each gum packet portion contains a dosage of gum and may be a single gum pellet or gum stick or the like or may be a plurality. However, for the exemplary food or confectionary packaging, each packet portion may contain a dosage of food or confectionary. Each gum packet portion is connected to at least one adjacent gum packet portion. A separation area such as a weakened area separates each adjacent gum packet portion. Adjacent gum packet portions are therefore able to be separated by severing through the gum packaging along the weakened area. Consequently, the gum packaging size can be tailored to individual requirements and the gum packaging can be reduced in size as the gum is consumed.

In the exemplary embodiments, each gum packet portion includes a pocket or the like for receiving the gum. Suitably, the pocket is substantially closed or sealed. Each pocket may be separated from the weakened area by a seal or join. In this way, separating a gum packet portion through the weakened area does not cause either of the adjacent gum packet portions to be opened. Alternatively, a part or all of the weakened area may be formed through a gum packet portion. Here, suitably, the weakened area or portion thereof is formed through an outermost adjacent gum packet portion in a direction of intended consumption. Consequently, separating the gum packet portion causes one of the separated gum packet portions to be opened or partially opened and preferably, the gum packet portion removed from the gum packaging to be opened or partially opened.

In one particular exemplary embodiment, each gum packet portion includes a pull tab or gripping portion. Here, the pull tab or gripping potion is arranged to be accessible when the respective gum packet portion is on an end of the gum packaging. For instance, in one particular exemplary embodiment, the tab of a gum packet portion is arranged between said gum packet portion and an adjacent gum packet portion. Alternatively, in another particular exemplary embodiment, a gripping portion of one gum packet portion is joined to an adjacent packet portion at the weakened area. Consequently, said gripping portion only becomes accessible when the gum packaging is severed along said weakened area. Suitably, the gripping portion may form an under/overhang of each gum packet portion when separated from the gum packaging. Suitably, the pull tab or gripping portion allows the gum packet portion to be easily opened.

In another particular exemplary embodiment, the gum packaging is formed by top and bottom opposed surface portions that form a closed space therebetween for receiving the gum. The opposed surfaces may be first and second sheet portions that may be separate or joined at a fold or the like. The gum packaging may be divided into gum packet portions by spaced ribs at each separation area to form closed pockets. The use of ribs rather than thinning the gum packaging in order to join the top and bottom surfaces directly enables a large area for advertisement that spans two or more gum packet portions.

In another particular exemplary embodiment, the separation area comprises a weakened band that extends about top and bottom opposed surface portions. Here, and according to one embodiment, a line along which the gum packet portion is arranged to separate through one surface is not parallel to that of the opposed surface. Consequently, an overhang on one side of a separated gum packet portion is formed and an under hang on the other. The under/overhang allows a gum packet portion to be easily emptied into a user's mouth without needing to handle the gum directly. The under/overhang also provides a convenient pull handle for a user to grip while separating the gum packet portion. A method of opening said exemplary gum packet portion may comprise biting downwards through the under/over hang in order to create an opening in the gum packet portion. It will be appreciated that according to a further aspect, there is therefore provided a gum packet portion having an over/under hang as described above and herein with reference to the exemplary embodiments.

In an alternative exemplary embodiment, the gum packaging is divided into gum packet portions by overlaying first and second sheet portions and forming at least one elongate join, such as a seal, directly between the first and second sheets. Here the gum packaging may form an elongate packaging wherein the gum packet portions are arranged in strip form. One or both of the opposed top and bottom surfaces may be substantially flat or one or both of the opposed top and bottom surfaces may be shaped. When supplied in strip form, one or more bends may be provided in the gum packaging. Consequently, a double deck of gum packet portions may be supplied or a concertina may be provided. Also, the bends may be arranged to supply the gum packaging in roll form.

In another particular exemplary embodiment, the gum packet portions are integrally formed as the gum packaging is formed. However, in a further exemplary embodiment, the gum packet portions are individually formed and then joined together. Adhesive may be used to bond each adjacent gum packet portion. Additionally, or alternatively each gum packet portion is adhesively bonded to an outer wrapper. Here, the outer wrapper includes a separation area or weakened area through which each adjacent gum packet portion can be separated from the other.

According to a further aspect, there is provided a gum packaging comprising at least two adjacent gum packet portions secured to each other wherein each adjacent gum packet portion is separable along a separation area or weakened area, and each gum packet portion includes a tab. Here the tab is easily grippable and arranged so that the separation of the adjacent gum packet portions can be affected by pulling the tab away from the other gum packet portion. Suitably, the tab may be connected to the gum packet portion at the separation area. Moreover, once each gum packet portion is separated, the tab may be connected to a weakened area of the gum packet portion so that pulling the tab in another direction to that required for separation, causes the gum packet portion to open. The tabs may be arranged between gum packet portions so that separating an adjacent gum packet portion exposes a tab of the next gum packet portion. The gum packaging and gum packet portions of this aspect may be used independently or in combination with the previous aspects.

According to a further aspect, there is provided a gum packaging or gum packet portion having an adhesive layer. This allows the gum packaging or gum packet portion to be attached to other substrates and enables a novel carrying method that enhances advertising ability. This further aspect may be used with any previous aspect or embodiment described herein. However, it is particularly suitable for gum packaging or gum packet portions having a flat surface.

According to a further aspect there is provided a method of opening gum packaging comprising the steps of removing a gum packet portion from a gum packaging and opening the gum packet portion to remove gum. The steps may be carried out in any order.

According to yet a further aspect there is provided a method of selling gum, the method comprising removing a sub gum packaging from a main gum packaging, wherein the sub gum packaging includes a number of gum packet portions according to the user-defined conditions of sale.

According to a still further aspect, there is provided a method of carrying a gum packaging or gum packet portion, wherein the gum packaging or gum packet portion comprises an adhesive layer, and the method comprises using the adhesive layer to attach the gum packaging or gum packet portion to a substrate and carrying the gum packaging or gum packet portion by carrying the substrate.

Any of the above method aspects may comprise carrying, opening or selling a gum packaging or gum packet portion according to the previous aspects or examples embodiments described above or herein.

BRIEF DESCRIPTION OF THE FIGURES

For a better understanding of the disclosure, and to show how embodiments of the same may be carried into effect, reference will now be made, by way of example, to the accompanying diagrammatic drawings in which.

DETAILED DESCRIPTION

According to an exemplary embodiment, a gum packaging 100 holding a plurality of gum products is provided. Advantageously, and in accordance with the exemplary embodiment, one or more gum packet portions 200 can be torn from the gum packaging 100 in order to reduce the size of the gum packaging 100. Here, each gum packet portion 200 contains a dosage of gum. Consequently, referring to FIG. 2, a retail outlet may sell gum packaging 100 having a user required number of gum dosages by tearing from a main gum packaging 100' a sub gum packaging 100" for purchase, wherein the sub gum packaging 100" has the required number of gum packet portions 200 according to the buyer's wishes. Furthermore, a user may purchase a main gum packaging 100' and remove a sub gum packaging 100" having a required dosage for that day or activity, where the sub gum packaging 100" has the required number of gum packet portions 200 according to the selected dosage. This is advantageous because the user only has to carry around the gum required. Moreover, as the gum is consumed and the used gum packet portions 200 torn or otherwise separated from the gum packaging 100, the gum packaging becomes smaller, and therefore more comfortable to carry around.

It will therefore be appreciated that the gum packaging herein described may be arranged to have n number of gum package portions, wherein n is any suitable number of gum packet portions greater than one. In the example shown in FIGS. 1-3, n is shown as seven. The gum packaging therefore has gum packet portions 200*a*-200*g*. Here, end gum packet portions 200*a* and 200*g* are only attached to one adjacent gum packet portion 200*b* and 200*f* respectively, whereas middle gum packet portions 200*b*-200*f* are each attached to two opposed gum packet portions.

In the exemplary embodiments, each gum packet portion 200 is connected to at least one adjacent gum packet portion 200. For instance the gum packaging 100 is formed as a single product, wherein each adjacent gum packet portion may be integrally formed with the other. Here, each gum packet portion 200 is separated from an adjacent gum packet portion by a separation area such as a weakened area that extends through the gum packaging. However, the gum packaging may be formed from a plurality of separate gum packet portions that are held together to form a single product. Here, for instance, each adjacent gum packet portion may be adhered together, where the adhesive forms a weakened area through which the adjacent gum packet portions can be separated. Alternatively or additionally, the separate gum packet portions may be held together with an outer sheath, wherein the outer sheath is fixed to each gum packet portion, the outer sheath including a weakened area through the gum packaging and each gum packet portion may be separated from an adjacent gum packaging through the weakened band.

Figure 2:
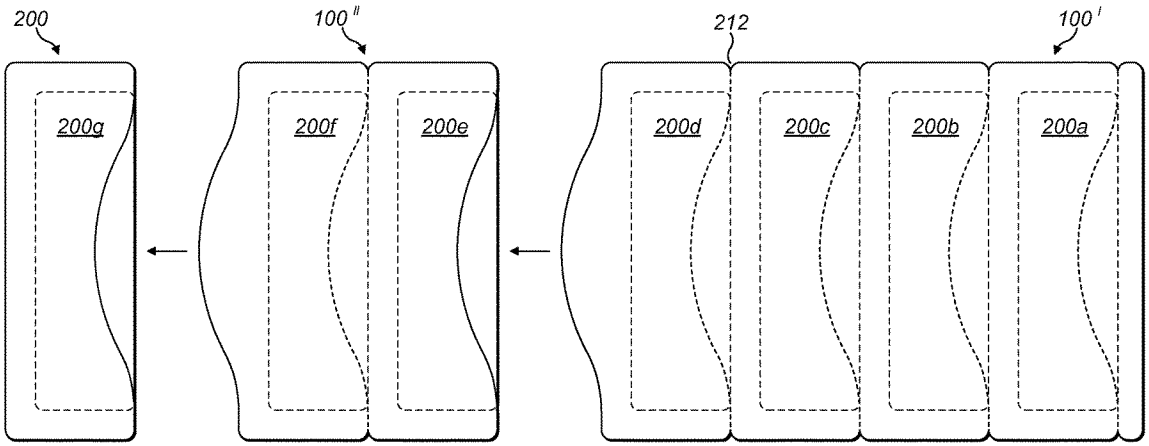
FIG. 2 shows a top view of the removal of a gum packet portion from the gum packaging shown in FIG. 1

As shown in the Figures, in an exemplary embodiment, the gum packet portions 200 may suitably be provided in a strip form. That is, the gum packet portions 200 may be arranged adjacent to each other in a line. Each gum packet portion 200 defines a separate compartment 202 such as a bag, pouch or wrapping for containing the gum product. Each gum packet portion 200 is joined to at least one adjacent gum packet portion at a weakened area 210. It will be appreciated that when in a strip form, the end gum packet portions are connected at one side only whereas the middle gum packet portions are connected to two adjacent gum packet portions, one on each side. Suitably the weakened area enables one gum packet portion 200 to be detached from the other by being torn or ripped therefrom. The weakened area may be formed from any known method for providing a separation. For instance, the weakened line may comprise a score or perforation, which may be either continuous or intermittent. As shown in FIG. 2, a tear initiator 212 may be provided to initiate the tear. Suitably, the tear initiator may be a notch.

The weakened line 210 is arranged so as to be between the compartments 202 of each gum packet portion for holding the gum. Consequently, when separated along the weakened line 210, neither of the compartments 202 of each respective adjacent gum packet portion 200 are opened. Consequently, when the gum packet portion is removed to reduce the size of the gum packaging 200 the freshness and hygiene of the gum in each unopened gum packet portion is maintained.

In use, the gum can be removed from an end gum packet portion either before or after separation from the gum packaging. Once gum is consumed from a respective gum packet portion, the gum packet portion can be disposed of separately to the remaining gum packaging 100.

The gum packaging and gum packet portions may take a number of forms and use any known packaging materials, assembly method and weakened area techniques as is suitable for the particular product or gum being packaged. However, various exemplary embodiments will not be described.

Figure 1:
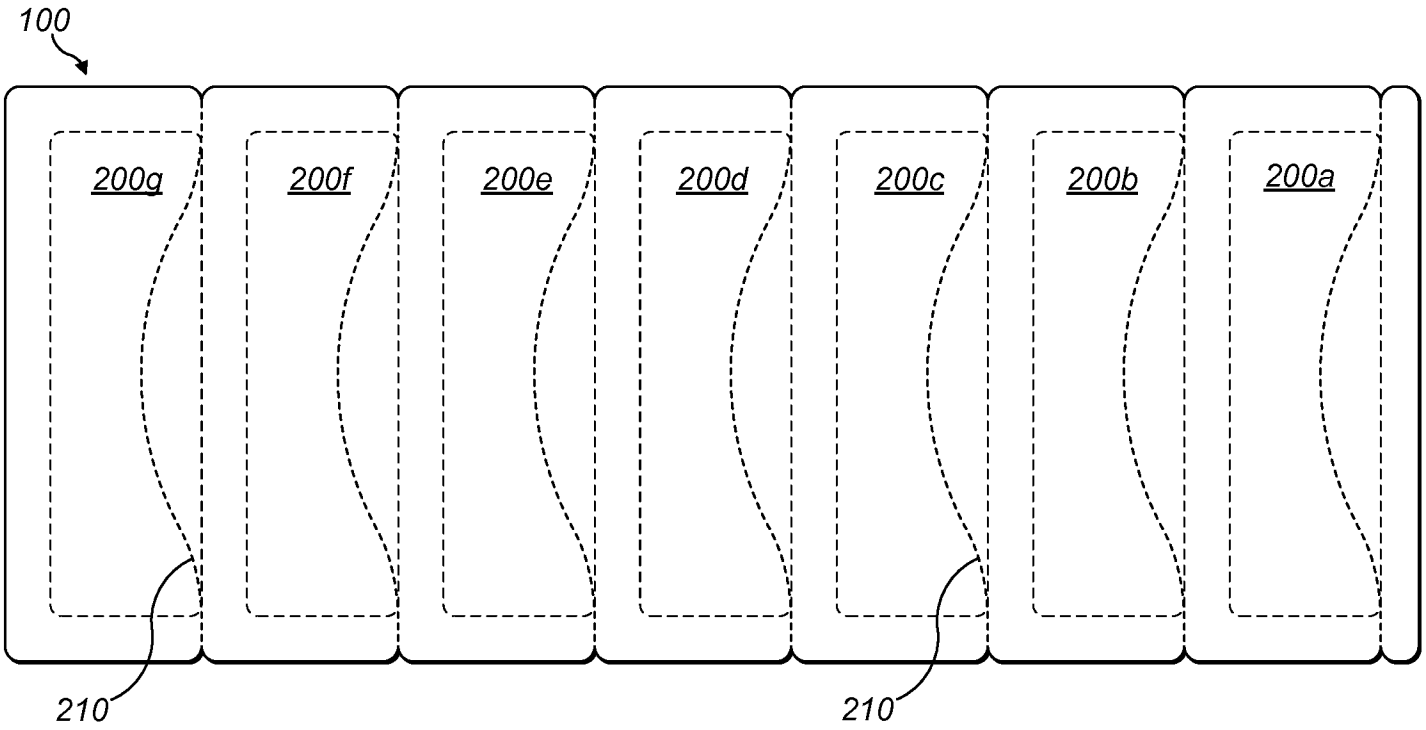
FIG. 1 shows a top view of a gum packaging according to a first embodiment.
Figure 3:
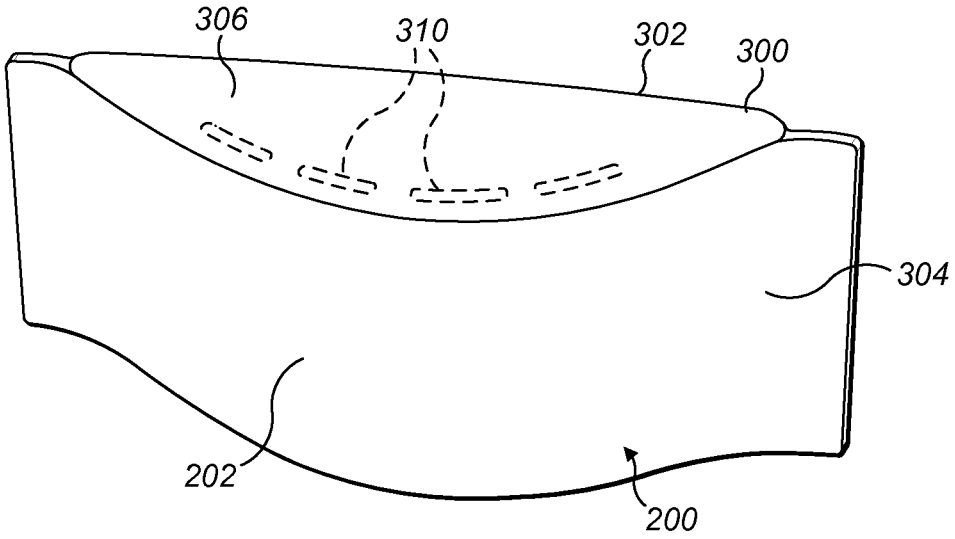
FIG. 3 is a perspective view of the gum packet portion removed from the gum packaging of FIG. 1.

Referring to FIGS. 1 to 3, an exemplary embodiment will now be described. Referring to FIG. 1, each gum packet portion 200 forming the gum packaging 100 is integrally formed with adjacent gum packet portions 200. At least one weakened area, and preferably a plurality of spaced weakened areas, run through the gum packaging 100 to separate the gum packaging into adjacent gum packet portions 200. In the exemplary embodiment shown in FIG. 1, the gum packaging is formed with a substantially constant outer cross-sectional shape when viewed from an end of the gum packaging 100. That is, two opposed sides of the packaging 100 are not bonded directly to each other at the weakened area but are instead separated by two spaced ribs running between the two surfaces and either side of a weakened area. Here, the weakened area therefore forms a substantially continuous weakened band that runs around the gum packaging 100. Thus, the outer cross-sectional shape at the weakened area is not substantially thinner than that of, for example, the centre of the gum packet portion 200 (as is the case in later exemplary embodiments). This is advantageous as it provides a continuous surface along the gum packaging 100 upon which advertising can be printed or otherwise displayed.

According to the exemplary embodiment shown in FIGS. 1 to 3, the separated gum packet portion 200 forms a bag 300, which may contain one or more gum products. Here, the bag 300 has two opposed surfaces forming a front 302 and back 304 of the bag. Sides 306 (only one of which is visible in FIG. 3) close the front and back walls to produce a closed or sealed bag containing the gum product. It will be appreciated that the sides 306 are the ribs previously described that separate the gum packaging 100 into gum packet portions 200. Advantageously, the front wall is arranged to tear along a non-parallel weakened line to that of the back wall when viewed from the front or back. In this case, the front and back walls are not adhered together at the weakened line, and the front and back sides therefore form a tubular type band. Consequently, the weakened area forms a weakened band that runs around a waist of the gum packaging 100. The weakened band is formed from a substantially continuous line that extends through the front and back of each bag. Because each gum packet portion 200 is suitably arranged to be identical, the respective weakened lines on the front and back of the packaging connecting opposed adjacent gum packet portions 200 are parallel, which creates an under hang and overhang of the front and back sides when viewed from either the front or back of the gum packet portion 200. When a gum packet portion 200 is on an end of the gum packaging 100 the under hang or overhang provides a convenient handle or grasping point to pull the gum packet portion away from the gum packing. A further advantage of the over/under hang is that when an opening is formed in a side wall 306 of the gum packet portion 200, the under hang can be used as a convenient lip to place against the users bottom lip to enable the gum product to be emptied into the users mouth without the need to touch the gum product. Furthermore, as explained above, the overhang at the opposite side can be used to hold the bag 300 during emptying into the users' mouth. Importantly, the user, when gripping the overhang, does not need to grip the gum product, which would otherwise be the case if the user had to grip the gum packet portion at the same location as the gum is stored and therefore allows the gum to freely dispense under gravity. However, where needed, the user can also push the side of the bag 300 nearest the overhang to encourage the gum to dispense.

The opening in the side 306 of the bag 300, can be formed in any known manner. It may be reclosable or a single use opening. However, according to the exemplary embodiment shown in FIG. 3, the opening may be formed from a series of perforations 310.

Although the bag may take any shape, suitably, in order to enhance the message of how to pour the contents into the users' mouth, one of the weakened lines on the front or back surfaces is arcuate. In this way, the arcuate edge formed on top of the under hang when the gum packet portion 200 is separated from the gum packaging, is shaped to conveniently fit a users' upper lip. To further enhance the message of the playful opening method, the perforations 310 to form an opening in the side wall 306 may also be shaped in an arc and the opening may be intended to be formed by the user biting downwards on the under hang, to tear through the perforations and to form an opening in the side wall 306. In this case, the perforations 310 may be suitably formed and arranged. However, as well as being partial perforations, the perforations may also be cuts formed from one side to the other of the side wall 306. In this case, the gum is kept fresh and hygienic whilst not separated from the gum packaging 100 due to the cuts only being open to the space between the pair of ribs (e.g. side walls 306) of adjacent gum packet portions which remains closed due to the weakened area not being opened and the front and back of the gum packaging 100 therefore keeping the space between the ribs closed.

According to the exemplary embodiments shown in FIGS. 4 to 11, the gum packing 100 is separated into adjacent gum packet portions 200 by directly sealing top and bottom opposed surfaces of the gum packaging to each other. For instance, suitably a seal is formed across the gum packaging 100 sealing the top and bottom opposed surfaces to each other. Here the weakened area is formed through the seal. However, a pair or parallel seals may also be formed and the weakened area formed between said seals. Whilst the substantially constant outer cross-section shape is not maintained at the weakened bands, which allows a large area on the gum packaging for advertising, the manufacturing complexities are reduced. Also, the advertising ability of the top and bottom surfaces that spans multiple gum packet portions 200 is only impacted if the rate of thinning at the seal is particularly great. That is, if the thickness at the middle of the gum packet portion is not substantial compared to the length of the gum packaging between spaced seals forming each gum packet portion, advertising continuation across multiple gum packet portions is maintained. Consequently, the gum packet portion 200 shown in the exemplary embodiments of FIGS. 4 to 11 are particularly, although not exclusively, suitable for a single dosage of gum, for example a single pellet or slab 110 (see FIG. 6).

Figure 4:
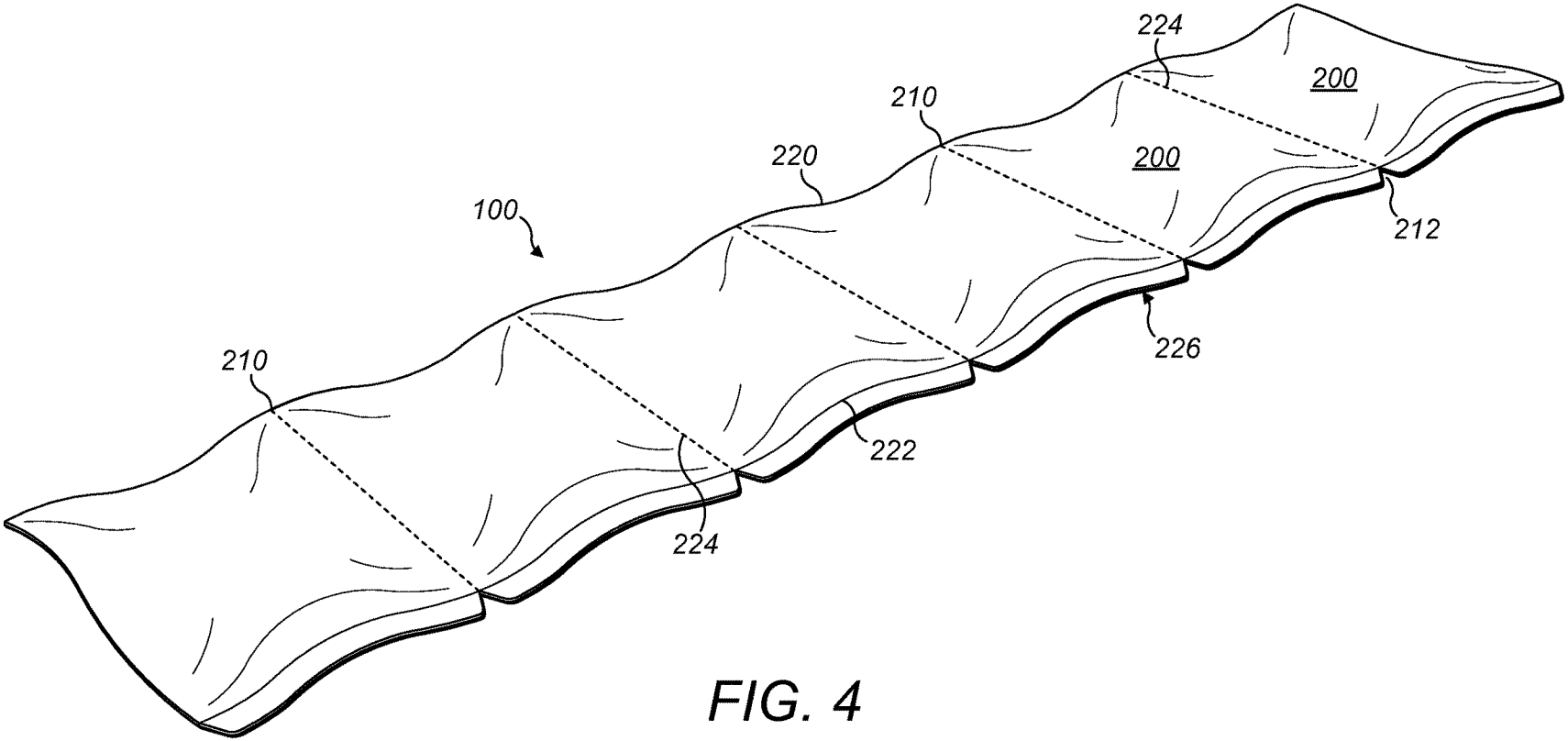
FIG. 4 shows a perspective view of a gum packaging according to a second embodiment.
Figure 5:
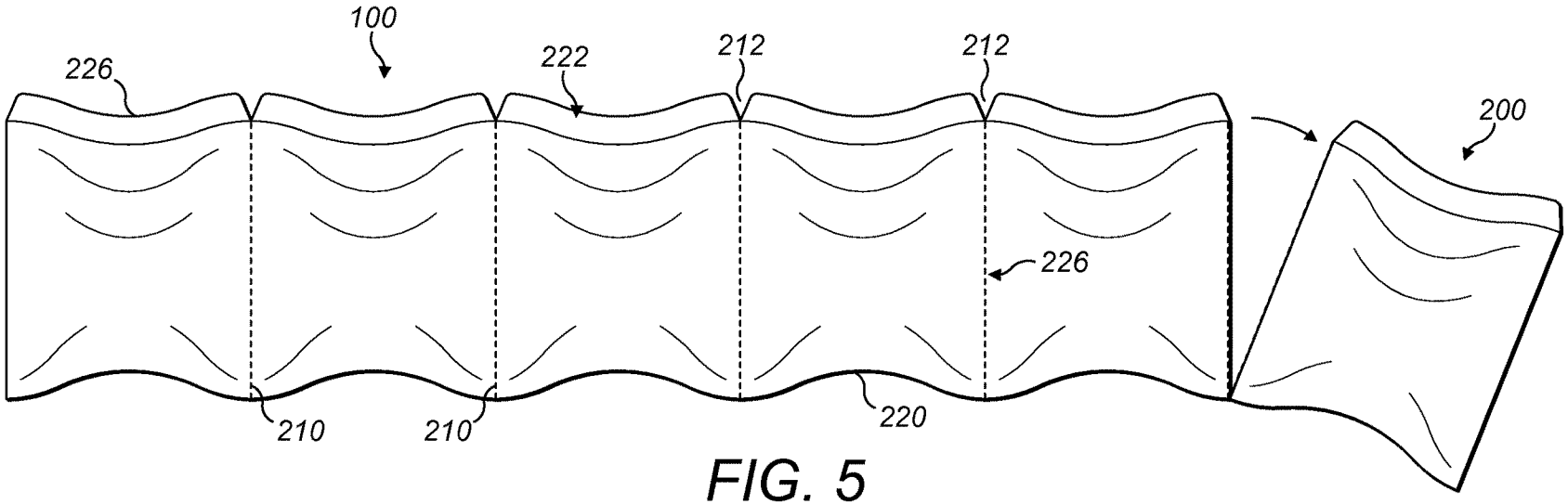
FIG. 5 shows a plan view of a gum packet portion being removed from the gum packaging of FIG. 4
Figure 6:
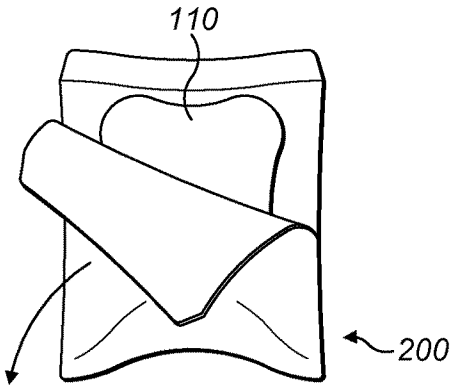
FIG. 6 shows a plan view of a partially opened gum packet portion removed from the gum packaging of FIG. 4.

Although the gum packaging 100 can be formed in any suitable manner, suitably the gum packing of one exemplary embodiment, as shown for example in FIG. 4, is formed from a single sheet of flexible packaging material. The sheet is folded at a fold 220, for instance along its length, to form an overlaid top and bottom surface portion. Here an edge seal 222, seals the edge opposite the fold 220 to form a tube. Cross seals 224 are then formed to separate the gum packaging 100 into gum packet portions 200. The weakened area 210 is formed through the cross seals 224 and is suitably a weakened line. Tear initiators 212, such as notches may be included. For instance, notches 212 may be suitably formed in an edge 226 that opposes the fold 220.

Suitably, in one particular exemplary embodiment, the edge seal 222 opposite the fold 220 is formed spaced from the edge 226 of the gum packaging 100. The top and bottom surfaces are therefore separate at the edge 226. Consequently, when the gum packet portion 200 is removed from the gum packaging (see FIG. 6), the gum packet portion 200 can be opened by peeling one of the top or bottom surfaces away from the other and separating the top and bottom surfaces through the seals. This enables easy access to the gum 110 and also allows secret or random messages or advertising to be printed on the inside of the gum packet portion, which is only exposed when the gum packet portion is opened. Additionally or alternatively, the cross seals may be spaced from the separation area so that when a gum package portion is separated, the top and bottom surface portions may not be joined at the edge so that the gum package portion may also be easily separated along this edge.

As mentioned the gum packaging may be formed using any well known techniques. However, particularly suitably, the seals may be formed by an adhesive such as a peelable adhesive such as a cold seal.

Figure 7:
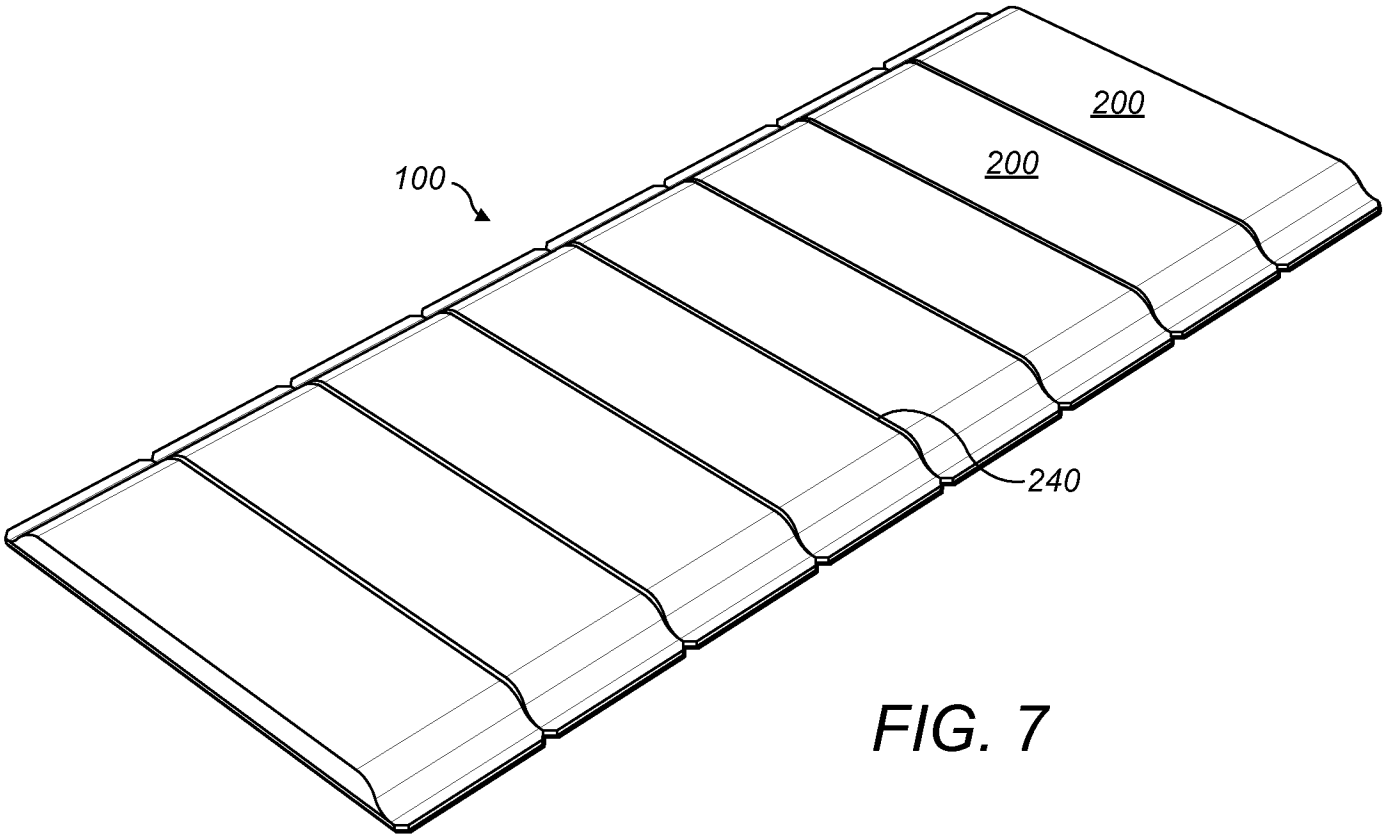
FIG. 7 shows a perspective view of a gum packaging according to a third embodiment.

Whilst in the exemplary embodiment described above in relation to FIGS. 4 to 6, one or both of the top and bottom surfaces of the gum packaging may be shaped, according to one exemplary embodiment the bottom surface of the gum packaging 100 is substantially flat. For instance, in the exemplary embodiment shown in FIGS. 7 and 8, whilst the gum packaging may be made as described above, the bottom surface may include an insert having a greater stiffness than the top surface or the bottom surface may have a different structural or material characteristic in order to have less pliancy than the top surface or folds or creases may be applied. Consequently, the top and bottom surfaces may be formed from two separate sheets. Referring to FIG. 7, the top surface may also be formed substantially flat. It will be appreciated that this could be achieved as described in the first exemplary embodiment using ribs between the two top and bottom sheets, wherein the ribs form side walls of each gum packet portion 200. However, in the exemplary embodiment shown in FIG. 7, the top sheet is non-continuous. That is, slots 240 are formed about the weakened area so only a tear or other separation along a plane of the bottom sheet is needed. As shown in the exemplary embodiment of FIG. 9, rather than forming actual ribs, the top sheet may be formed about the gum and bent into a u-shaped or v-shaped channel so that the top surface may again be sealed directly to the bottom surface.

Figure 8:
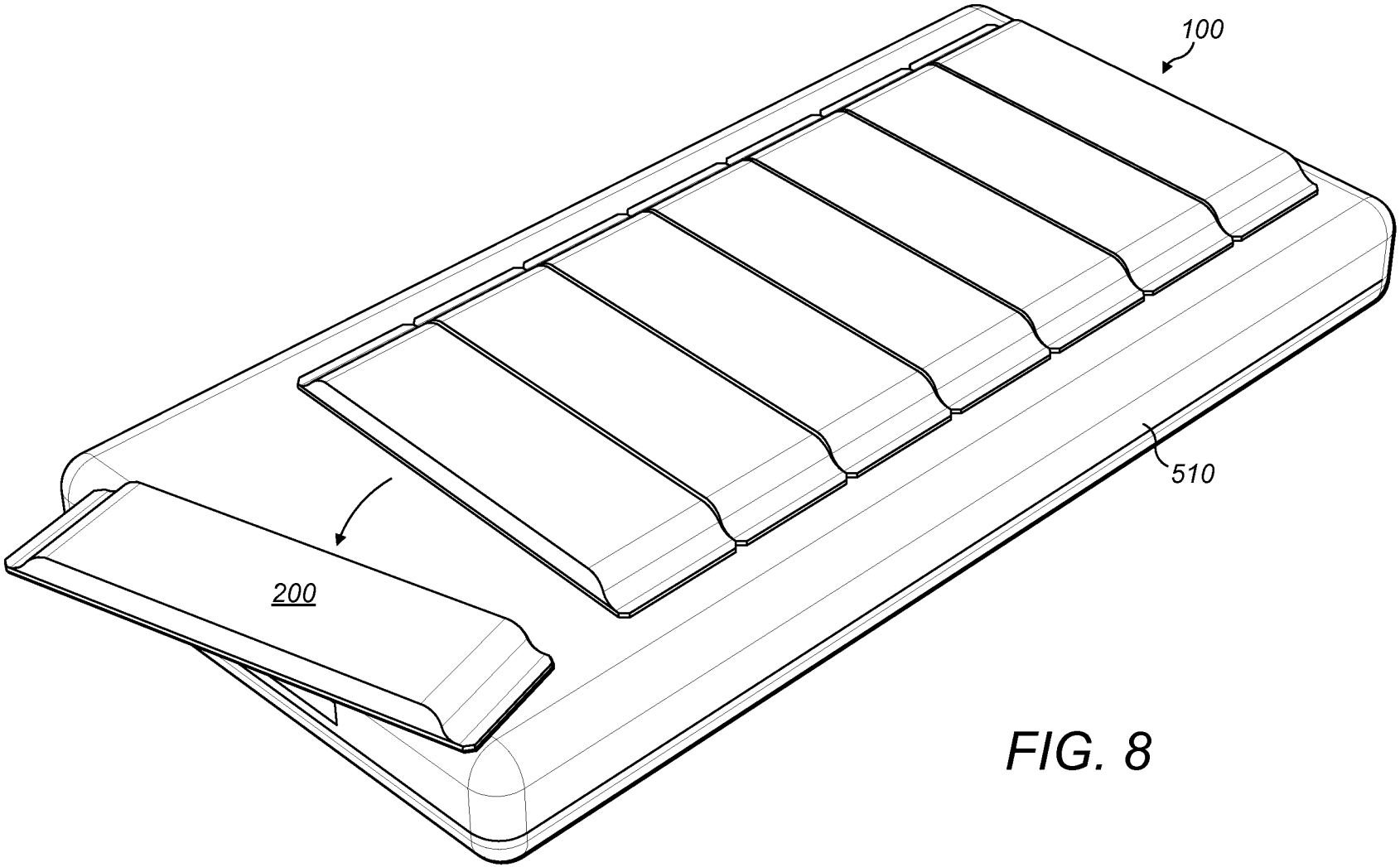
FIG. 8 shows a perspective view of a gum packet portion being removed from the gum packaging of FIG. 7.
Figure 10:
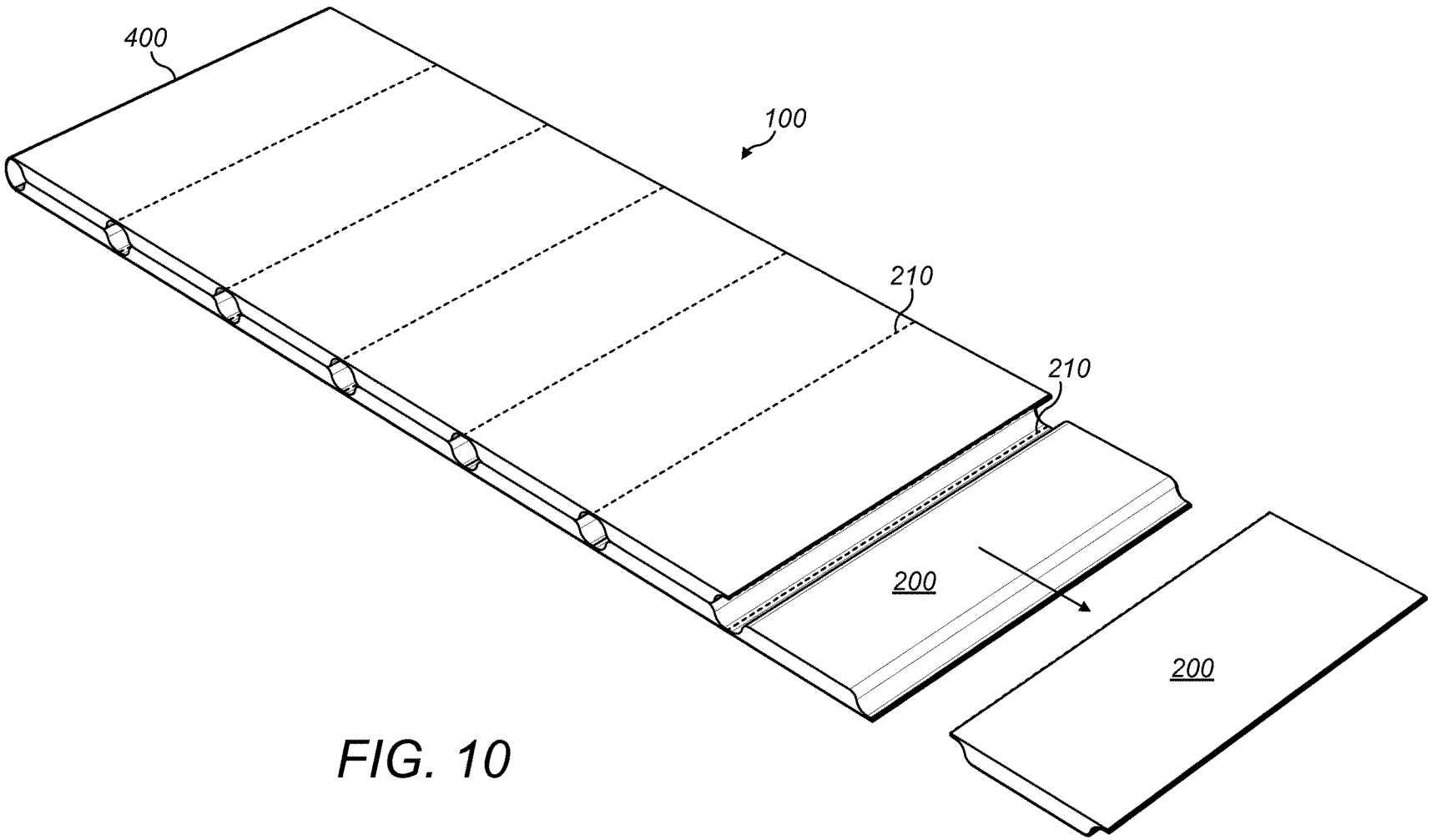
FIG. 10 shows a perspective view of a gum packet portion being removed from the gum packaging of FIG. 9.

The gum packet portion 200 can be removed from another gum packet portion by, for example, tearing along the weakened area as shown in FIGS. 8 and 10.

Figure 9:
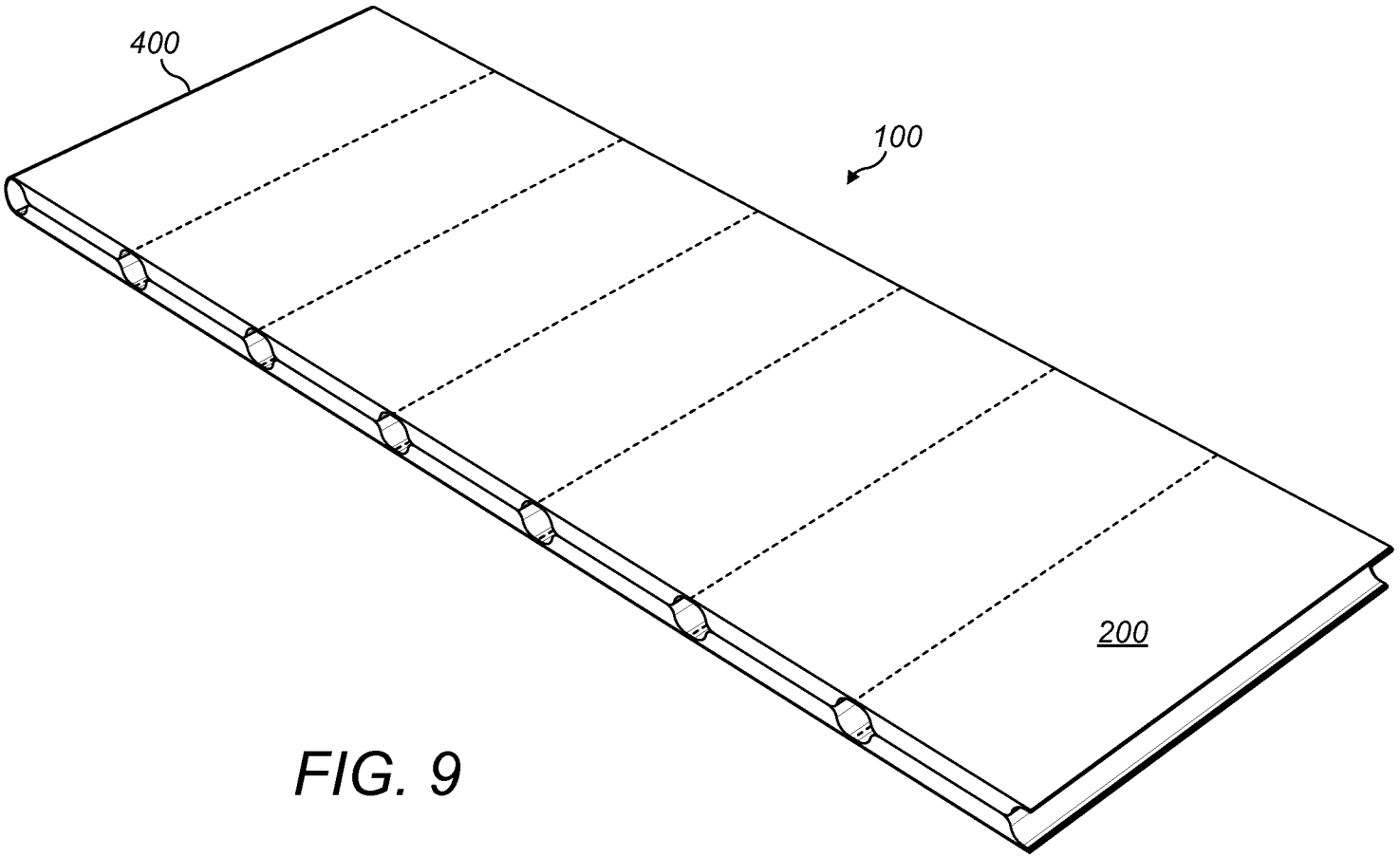
FIG. 9 shows a perspective view of a gum packaging according to a fourth embodiment.

According to the exemplary embodiments, the gum packet portions may be integrally formed in a strip. In one exemplary embodiment, for example as shown in FIGS. 1 to 8, the gum packaging may be supplied substantially linearly or flat. However, referring to FIG. 9, at least one bend 400 may be provided in the gum packaging 100. Suitably, the bend 400 is provided at the weakened area. For example, using a seal area. The bend 400 may allow the gum packing to be supplied in a double thickness or more bends may be provided to add further layers. Consequently, a concertina affect may be used to supply the gum packaging 100. Furthermore, the gum packaging 100 may even be bent at each weakened area between adjacent gum packet portions and supplied in a concertina. Whilst FIG. 9 shows an exemplary embodiment having a particularly suitable bend angle of 180°, other bend angles are envisaged. For instance, 90° or 45°. The bend angles may also not be constant and the bend angles may be such that the gum packaging is supplied in roll form, wherein the gum packet portions can be unwound from the gum packaging.

Figure 11:
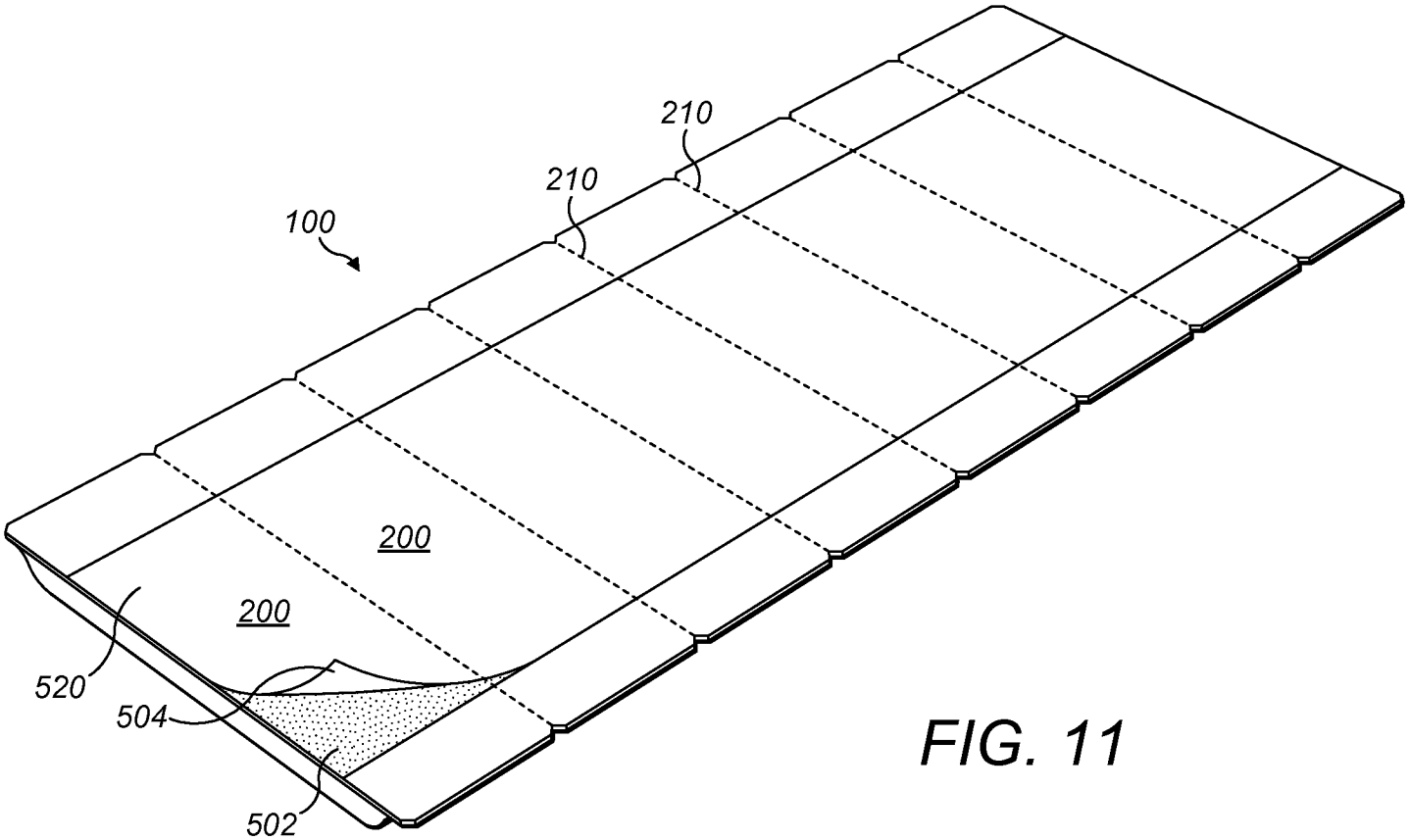
FIG. 11 shows a perspective view of a gum packaging according to a fifth embodiment.

Referring to FIG. 11, a further exemplary embodiment is shown. Here, the gum packaging includes an adhesive layer 500. The adhesive layer allows the gum packaging 100 or individual gum packet portions 200 to be adhered to other products. For example, as shown in FIG. 8, the gum packaging 100 may be adhered to a mobile phone 510. Consequently, the gum may be easily transported, whereas otherwise, the gum packaging is typically carried in a bag or pocket and can become lost or damaged. A further benefit is that the adhesive layer allows the gum packaging 100 to be carried in a visible manner, which enhances the advertising capacity.

In the exemplary embodiment, the adhesive layer 500 includes an adhesive 502 that may be a tacky or self-adhesive layer and may have suitable adhesive characteristics to allow the gum packaging 100 to be re-applied to different substrates. Such adhesive layers 500 are well known. According to one exemplary embodiment, and as shown in FIG. 11, an adhesive backing 504 is included so that the adhesive layer 502 only becomes accessible once the backing layer 504 has been removed. Again, such layers are known in the field of stickers. Here, hidden messages or images may be uncovered when peeling back the adhesive backing 504, for example, messages or images may be displayed on the adhesive layer 502 or under side of the backing 504.

In the exemplary embodiments, the weakened area 210 extends through the adhesive layer 500. Thus the separation of the gum packet portion 200 also separates the adhesive layer 500. Individual gum packet portions 200, the gum packing 100 or main/sub gum packaging 100'/100" may therefore all be adhered to substrates. Here, the weakened area through the adhesive backing 504 may be strong enough to keep together during peeling so that the adhesive backing 504 can be removed from a plurality of gum packet portions at one time, and only tears when initiated to do so at a tear initiator (i.e. when the gum packet portion is removed). Alternatively, the adhesive backing strip may be removed individually from each gum packet portion. Suitably, according to the embodiment shown in FIG. 11, the adhesive layer is formed on a substantially flat surface, for instance a back surface of the gum packaging 100.

Figure 12:
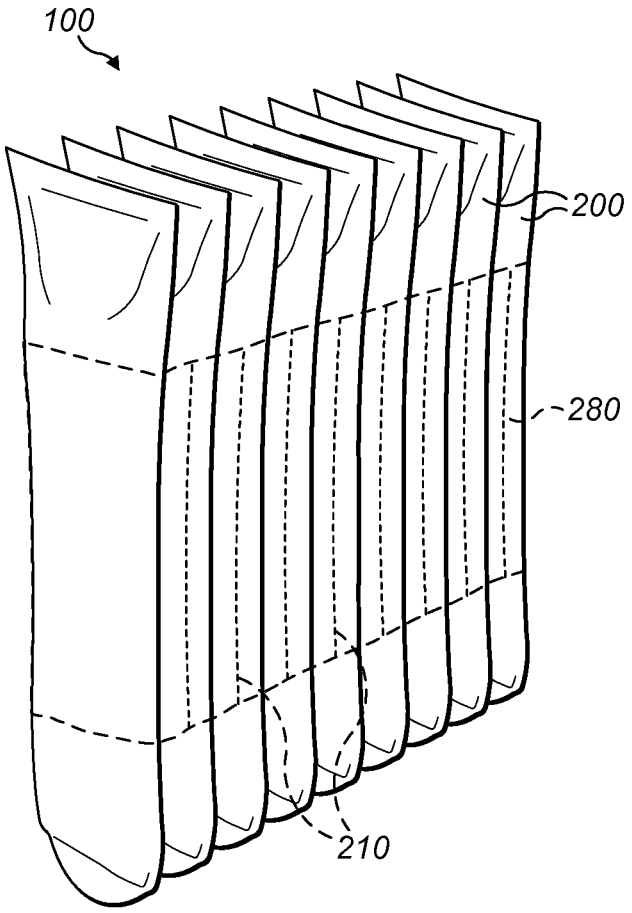
FIG. 12 shows a perspective view of a gum packaging according to a sixth embodiment.
Figure 13:
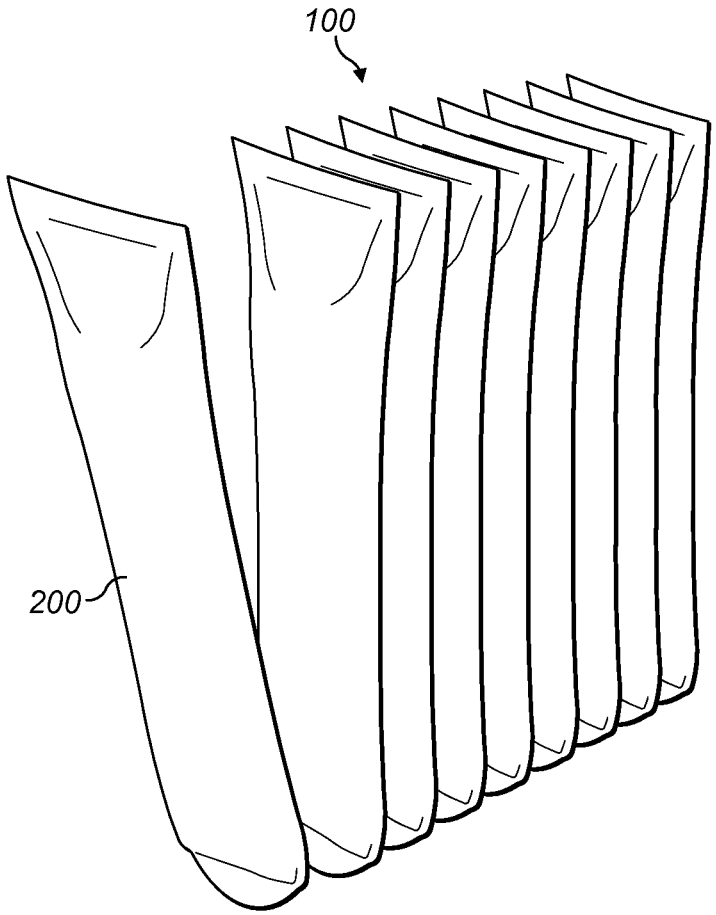
FIG. 13 shows a perspective view of a gum packet portion being removed from the gum packaging of FIG. 12.

In the exemplary embodiments described above, the gum packet portions have been formed integrally with each other. In a further exemplary embodiment, the gum packet portions 200 are formed individually and then joined together to form the gum packaging 100. For instance, with reference to FIG. 12, slabs of gum are packaged into gum packet portions 200 and then formed into a gum packaging 100 by joining at least one gum packet portion 200 to an adjacent gum packet portion 200. Here, each adjacent gum packet portion 200 may be adhered to the other and the adjacent gum packet portions 200 being separated by tearing through the adhesive, or by tearing along the bond between the adhesive and gum packet portion (see FIG. 13). Additionally or alternatively, in a further exemplary embodiment, the gum packet portions 200 are held together by an outer wrapping 280 (shown in dotted detail in FIG. 12). Here, each gum packet portion is adhered to a portion of the outer wrapping. Furthermore, the outer wrapping includes weakened areas 210 through which the outer wrapping 280 can be separated in order to separate adjacent gum packet portions. In the exemplary embodiment, because the outer wrapping is a band, the weakened area forms parallel lines on either side of the band. However, should the outer wrapping extend over a top and/or bottom, the weakened area may form a substantially continuous line or band.

Figure 14:
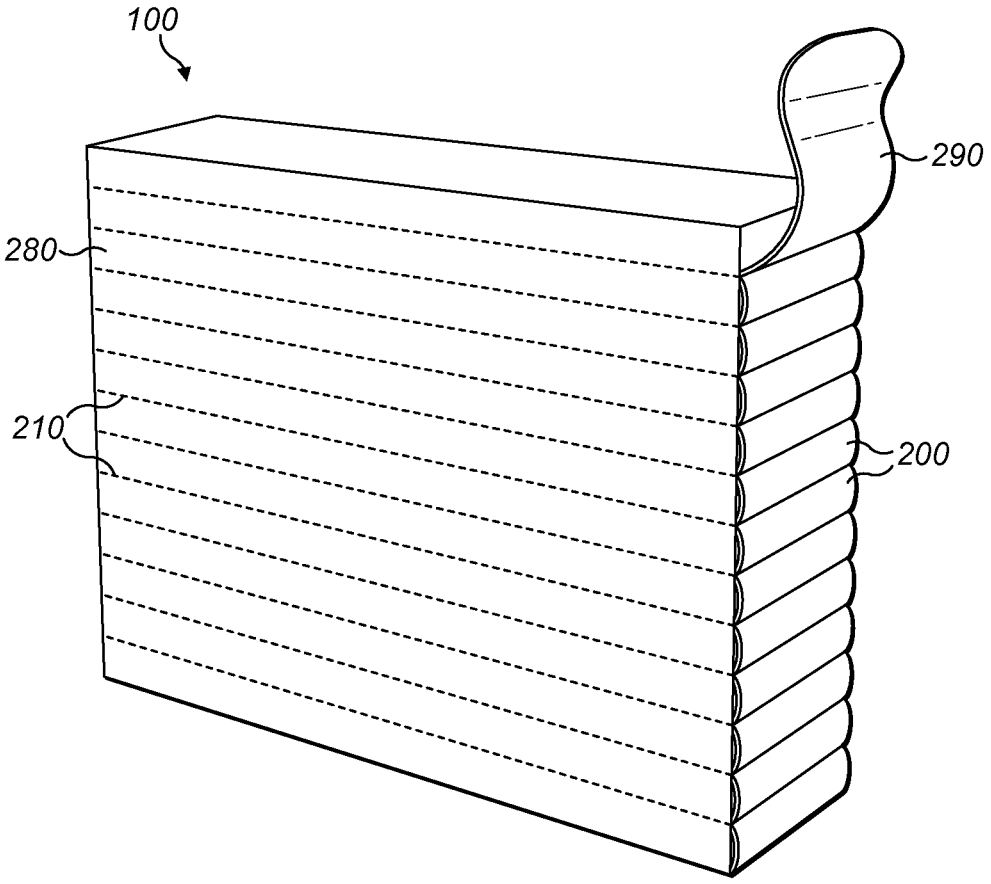
FIG. 14 shows a perspective view of a gum packaging according to a seventh embodiment.
Figure 15:
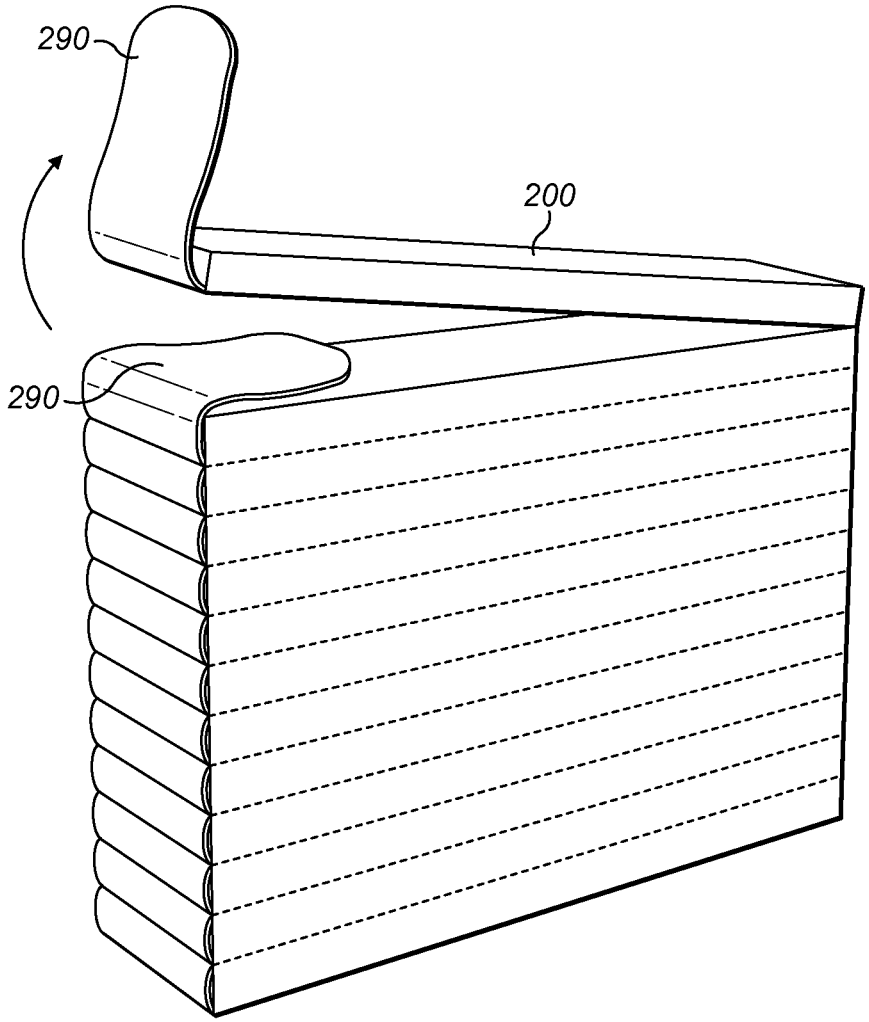
FIG. 15 shows a gum packet portion being removed from the gum packaging of FIG. 12.

In an alternative exemplary embodiment, and as shown in FIGS. 14 and 15, the outer sheath 280 is formed the full width of the gum packaging 100. Suitably, the gum packet portions 200 are substantially box, shaped and therefore, when stacked together, a substantially box-shaped gum packaging 100 is produced. Advantageously, in this embodiment, each gum packet portion 200 is provided with a flap 290. Here the flap extends the gum packet portion and suitably from the surface of the gum packet portion 200 that is attached to the adjacent gum packet portion when on the end of the gum packaging in a direction of opening. Consequently, the flap 290 provides a convenient handle for the user to grasp when separating the end gum packet portion. Moreover, because the flap is connected near the weakened are, the flap encourages the tear or other separation means to propagate at the weakened line. As shown in FIG. 15, as the end gum packet portion is removed from the gum packaging 100, the flap of the underlying gum packet portion 200 is exposed to allow subsequent separation. A further benefit of the flap 290 is that it may be used to provide an easy opening to the removed gum packet portion. For instance, the flap may be arranged with a weakened line or lines that extend around the gum packet portion such that when peeled back against the direction the flap is pulled to cause separation of the gum packet portion 200, the flap 290 causes the gum packet portion to open so that the gum may be removed.

The exemplary embodiments described herein provide an improved gum packaging that allows the size of the gum packaging to be easily tailored to suit specific needs and also allows the gum packaging to be reduced in size as the gum is consumed without affecting hygiene. Also, according to a number of the exemplary embodiments, an improved gum packet portion is provided having an easy or playful opening method, and these features may be used in isolation of the other features, and in particular, may be adopted on known gum packaging without gum packet portions. Furthermore, a gum packaging having an improved carrying method is provided through the inclusion of an adhesive layer. Again, the adhesive layer may be applied to any of the gum packaging or gum packet portions of the exemplary embodiments described herein irrespective of whether a flat area is provided that spans multiple gum packet portions. For instance, each gum packet portion may have an individual adhesive layer. Also, the adhesive layer may be used independently from the gum packaging having gum packet portions and, in particular, may be incorporated on known gum packaging to improve the carrying method.

The exemplary embodiments also enable the application of new social media methods. For instance, each gum packaging may contain a unique code or indicator that a purchaser can register against a social media or other profile, for instance through an internet site. Each gum packet portion may also include the unique code or indicator and the user may therefore pass a gum packet portion to a friend or new acquaintance in order for that person to use the unique code to establish contact through the social media channel. Alternatively, only one or certain special one or more of the gum packet portions may include the unique code or indicator of the gum packaging.

Due to the consumption habits of gum consumers, the exemplary embodiments are particularly advantageous for gum packaging and have therefore been described in relation to gum packaging. However, the exemplary embodiments are envisaged as being beneficial for the same reasons for other suitable products such as cheese portions, biscuits, beverages such as powdered or particulate beverages, tablets, candy, chocolate or the alike confectionary products.

Attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. A food packaging having two or more adjacent food packet portions, wherein each food packet is joined to the other at a respective separation area, wherein an outer most food packet portion at an outermost end of the food packaging is removable from the food packaging by separating the outermost food packet portion from a remaining food packet portion through the respective separation area; wherein each food packet portion includes a tab or gripping portion and the removed outermost adjacent food packet portion conceals the tab or gripping portion of the remaining food packet portion until the removed outermost food packet portion is separated from the remaining food packet portion such that the remaining food packet portion becomes the new outermost food packet portion at the outermost end of the food packaging, wherein the tab or gripping portion of the remaining food packet portion is joined to the removed adjacent food packet portion at the separation area whereby the tab or gripping portion of the remaining food packet portion only becomes accessible when the outermost food packet portion is removed at the separation area, wherein the food packaging is formed from a first sheet portion and a second opposed sheet portion, wherein each pair of adjacent food packet portions are separated by a pair of spaced ribs that extend between the first and second sheet portions and are positioned on either side of the separation area; and wherein the separation area is a weakened band and the weakened band comprises a continuous weakened line and a portion of the weakened line formed in the first sheet portion is not in direct recognition with the portion of the weakened line formed in the second sheet portion, thereby forming an over or under hang as the tab or gripping portion.

2. The food packaging of claim 1, wherein the tab or gripping portion of each food packet portion cooperates with an opening of the food packet portion, so that the tab or gripping portion can be used to open the food packet portion.

3. The food packaging of claim 1, wherein the separation area is arranged so that each adjacent food packet portion remains closed after separation from an adjacent food packet portion.

4. The food packaging of claim 1, wherein the separation area is arranged so that one of the adjacent food packet portion is automatically opened during separation.

5. The food packaging of claim 1, wherein a weakened area is provided to form an opening to the food packet portion and through the rib.

6. The food packaging of claim 5, wherein the portion of the continuous weakened line in the first sheet portion is parallel in relation to the portion of the weakened line in the second sheet portion.

7. The food packaging of claim 1, wherein the food packet portions are substantially identical in shape and form.

8. The food packaging of claim 1, wherein the food packet portions are arranged in a linear strip.

9. The food packaging of claim 8, wherein the food packaging is arranged in roll form.

10. The food packaging of claim 1, wherein the food packaging includes at least one bend.

11. The food packaging of claim 10, wherein the food packaging is arranged in roll form.

12. The food packaging of claim 1, wherein the food packaging includes at least two bends so the food packet portions are arranged in a concertina form.

13. The food packaging of claim 1, wherein the food packet portions are individually formed and the food packaging is provided by adhering each adjacent food packet portion to a respective adjacent food packet portion.

14. The food packaging of claim 13, wherein the food packet portions are individually formed and the food packaging is provided by adhering each food packet portion to an outer sheath, wherein the outer sheath includes weakened areas to allow the outer sheath to separate between each adjacent food packet portion.

15. A method of selling or using a food packaging according to claim 1, the method comprising separating the adjacent food packet portion from the corresponding adjacent food packet portion to separate a main food packaging into a sub food packaging, wherein the sub food packaging comprises a determined number of food packet portions based on a user-determined requirement.

16. A method of using a food packaging according to claim 1, wherein the food packaging comprises at least two food packet portions, the method comprising the steps of:

separating a food packet portion from a corresponding adjacent food packet portion; and opening said food packet portion to access food contained therein.

17. The method of claim 16, wherein the food packet portion includes an over/under hang and the step of opening the food packet portion comprises biting on the overhang to cause an opening in the food packet portion.

* * * * *